US008025207B1

(12) United States Patent
Correll

(10) Patent No.: US 8,025,207 B1
(45) Date of Patent: Sep. 27, 2011

(54) MATERIAL-SAVING PIZZA BOX

(76) Inventor: John D. Correll, Canton, MI (US)

( * ) Notice: Subject to any disclaimer, the term of this patent is extended or adjusted under 35 U.S.C. 154(b) by 388 days.

(21) Appl. No.: 12/313,829

(22) Filed: Nov. 25, 2008

Related U.S. Application Data

(63) Continuation-in-part of application No. 11/017,369, filed on Dec. 20, 2004, now abandoned, which is a continuation-in-part of application No. 10/784,381, filed on Feb. 23, 2004, now abandoned, which is a continuation-in-part of application No. 10/431,984, filed on May 8, 2003, now abandoned.

(51) Int. Cl.
*B65D 5/00* (2006.01)

(52) U.S. Cl. ..... 229/110; 229/906; 229/149; 229/188

(58) Field of Classification Search ..... 229/110, 229/906, 149, 163, 188
See application file for complete search history.

(56) References Cited

U.S. PATENT DOCUMENTS

| | | | | |
|---|---|---|---|---|
| 2,544,565 | A * | 3/1951 | Phillips | 229/145 |
| 5,368,225 | A * | 11/1994 | Ritter | 229/110 |
| 5,402,929 | A * | 4/1995 | Ritter et al. | 229/110 |
| 5,467,916 | A * | 11/1995 | Beales | 229/195 |
| 5,702,054 | A | 12/1997 | Philips et al. | |
| 6,092,715 | A * | 7/2000 | Correll | 229/110 |
| 6,749,106 | B2 * | 6/2004 | Keefe et al. | 229/110 |

* cited by examiner

*Primary Examiner* — Tri Mai

(57) ABSTRACT

A pizza box and blank having a unique cover-locking structure comprising (a) a tab extending from a front end edge of a panel of a side wall assembly and (b) a tab engaging edge disposed in or on a cover assembly. A main advantage is a cover-locking structure that provides ease of use and secure cover closure, along with possible material savings.

6 Claims, 5 Drawing Sheets

MATERIAL-SAVING PIZZA BOX

CROSS-REFERENCES

This application is a continuation-in-part application of my application Ser. No. 11/017,369 filed Dec. 20, 2004, which is a continuation-in-part application of application Ser. No. 10/784,381 filed Feb. 23, 2004, which is a continuation-in-part application of application Ser. No. 10/431,984 filed May 8, 2003.

GOVERNMENT RIGHTS

Not Applicable

REFERENCE TO COMPACT DISCS

Not Applicable

FIELD OF THE INVENTION

This invention relates to packaging in general and in particular, but not by way of limitation, to boxes and box blanks for food products such as pizza and the like.

BACKGROUND

Each year thousands of pizza businesses sell millions of hot pizzas for delivery and carry-out. The success of these businesses depends to an extent on the cost and functionality of the boxes used for packaging the product. Ideally, these boxes should be cost-effective and easy to use.

To achieve cost-effective, easy to use packaging, it would be desirable to have a cover-locking structure that requires only a minimal amount of extra material to incorporate into a box blank and also is easy to operate and maintains a reasonably tight cover closure after repeated opening-and-closings of the box. This is particularly the case with the D-type pizza box presently used by Domino's Pizza.

Information relevant to attempts to address these problems and achieve this type of pizza packaging can be found in Philips et al. U.S. Pat. No. 5,702,054 granted Dec. 30, 1997 and Keefe, Jr. et al. U.S. Pat. No. 6,749,106 B2 granted Jun. 15, 2004.

Philips et al. discloses a cover-locking structure comprising a tab at opposing ends of a cover front flap with the projections engaging with slits at opposing ends of the front wall assembly. The height of the cover front flap is substantially the same height as that of the front wall of the box. This cover-locking structure is relatively material-efficient and easy to use. This cover-locking structure is presently in use on the Domino's Pizza pizza box.

Keefe, Jr. et al. discloses a relatively complex cover-locking structure consisting of a tab extending from a front end edge of each of a pair of diagonal corner panels attached to a front end of side wall panels. Further, the front wall of the box contains openings for receiving the tabs. The engagement of the tabs with these openings serves to hold the corner panels and attached side wall panels in upright or vertical position. Still further, there is a flap attached to the top edge of the front wall. Finally, there are cover diagonal flaps attached to front diagonal edges of the cover panel. These cover flaps wrap around the ends of the front wall flap when the box is closed and, thereby, hold the cover in closed disposition.

In conclusion, it would be highly desirable to provide a pizza box and blank that satisfies the need for cost-effectiveness and ease of use, particularly as applies to the D-style pizza box presently used by Domino's Pizza.

SUMMARY OF THE PREFERRED EMBODIMENT

In accordance with the presently preferred embodiment, my invention is a box and associated blank having a unique cover-locking structure comprising (a) a tab (46) projecting from a front end edge of a panel of a side wall assembly (30) and (b) a tab engaging edge (65) disposed in or on a cover assembly (60) of the box and which engages with the tab, thereby acting to hold the cover assembly in a closed disposition. In addition, the preferred embodiment has a configuration of front wall assembly that enables the blank to be shipped without damage to the tab. This is provided by a unique protector flap (51) that's included in the front wall assembly. Further, the preferred embodiment includes unique breaker line slits (47) in a side wall. Still further, the preferred embodiment has a configuration of side wall assemblies and cover side flap assemblies that enable multiple blanks of the preferred embodiment to be nested in inverted-mated configuration (FIG. 6) during manufacture, thereby providing a savings in material. Additional features of the preferred embodiment will become clear from a study of the detailed description that follows.

The presently preferred embodiment typically would be used for packaging relatively flat food products such as pizza; however, the invention could take other forms and be used for other purposes, as well.

A complete understanding of the preferred embodiment can be obtained from the detailed description that follows.

POTENTIAL ADVANTAGES OF THE PREFERRED EMBODIMENT

The preferred embodiment, as described in a subsequent section, affords the advantage of having a cost-effective, easy to use pizza box.

Further advantages of the preferred embodiment will become apparent from consideration of the following detailed description, related drawings, and appended claims.

LIST OF REFERENCE NUMERALS

Figure 1:
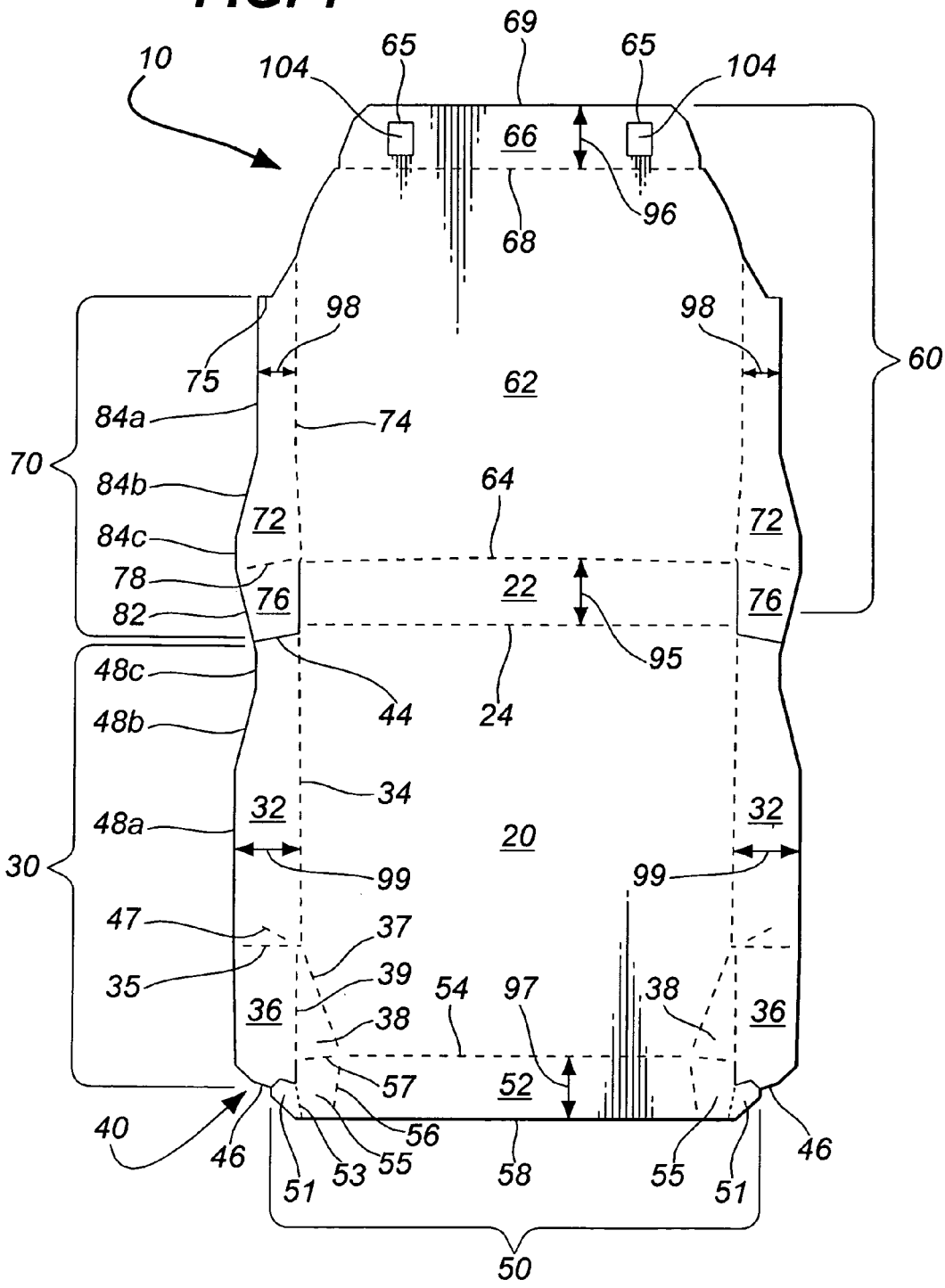
FIG. 1 shows a plan view of a preferred embodiment of the box blank.

Within a drawing, closely-related components have the same number but different alphabetic suffixes. Between drawings, like reference numerals designate corresponding parts.

| | |
|---|---|
| 10 | blank of the preferred embodiment |
| 10' | blank of the preferred embodiment |
| 10a | blank of the preferred embodiment with variation in cover front flap opening |
| 10b | blank of the preferred embodiment with variation in cover front flap opening |
| 10X | blank of alternate embodiment |
| 12 | box of the preferred embodiment |
| 20 | bottom panel |
| 22 | rear wall |
| 24 | rear wall fold line |
| 30 | side wall assembly |
| 32 | side wall panel |
| 34 | side wall fold line |
| 35 | front corner panel fold line |
| 36 | front corner panel |
| 37 | fold line |
| 38 | connector panel |
| 39 | fold line (bottom edge of corner panel) |
| 40 | front end edge of corner panel |
| 44 | rear end of side wall panel |
| 46 | tab (a.k.a. engagement tab) |
| 46X | tab on alternate embodiment |
| 47 | breaker line slits |
| 48a | top edge portion of side wall panel |
| 48b | top edge portion of side wall panel |
| 48c | top edge portion of side wall panel |
| 50 | front wall assembly |
| 51 | protector flap |
| 51X | protector flap of alternate embodiment |
| 52 | front wall |
| 53 | protector flap fold line |
| 54 | front wall fold line |
| 55 | end flap |
| 56 | end flap fold line |
| 57 | connector panel fold line |
| 58 | top edge of front wall |
| 60 | cover assembly |
| 62 | cover panel |
| 64 | cover panel fold line |
| 65 | tab engaging edge |
| 65a | tab engaging edge |
| 65b | tab engaging edge |
| 65X | tab engaging edge of alternate embodiment |
| 66 | cover front flap |
| 66X | cover front flap of alternate embodiment |
| 68 | cover front flap fold line |
| 69 | bottom edge of cover front flap |
| 70 | cover side flap assembly |
| 72 | cover side flap |
| 74 | cover side flap fold line |
| 75 | front end of cover side flap |
| 76 | corner flap |
| 78 | corner flap fold line |
| 82 | lower edge of corner flap |
| 84a | lower edge portion of cover side flap |
| 84b | lower edge portion of cover side flap |
| 84c | lower edge portion of cover side flap |
| 95 | height of rear wall |
| 96 | height of cover front flap |
| 96X | height of cover front flap (alternate embodiment) |
| 97 | height of front wall |
| 98 | minimum height of cover side flap (a.k.a. predetermined minimum height) |
| 99 | maximum height of side wall panel |
| 104 | opening, hole, or knock-out |
| 104a | flap-type opening |
| 104b | flip-tab type opening |
| 104X | hole or knock-out for alternate embodiment |
| A1 | angle between fold lines |
| A2 | angle between fold lines |

DETAILED DESCRIPTION OF THE PRESENTLY PREFERRED EMBODIMENT

In the drawings there is illustrated a presently preferred embodiment, or best mode, in the format of a one-piece blank and, correspondingly, in the format of a box created from the blank. The intended use for the embodiment is as a food carton or, specifically, a pizza box. However, it will be appreciated, as the description proceeds, that my invention may be realized in different embodiments and may be used in other applications. The preferred embodiment is created from corrugated board; however, other foldable materials can be used, as well.

It is noted that the presently preferred embodiment is bilaterally symmetrical (i.e., having identical left and right sides). Therefore, pairs of opposing like components are to be found, with one item of the pair on each side of the blank or box. For simplicity of labeling, both components of an opposing pair bear the same reference numeral.

In some cases, for illustrative simplicity, only one item of a pair of opposing like components is numerically labeled (typically the left side of the drawing is completely labeled while the right side may be only partially labeled). Where this occurs, it is to be understood that the discussion applies to both components of the pair, even though only one of the components may be numerically labeled in the drawings and referenced in the description. Further, it is to be understood that where a component on one side of a drawing lacks a reference numeral, that component impliedly possesses the same reference numeral as the corresponding component on the other side.

The preferred embodiment comprises, in large part, improvements applicable to (but not limited to) the box and blank disclosed in Correll U.S. Pat. No. 6,547,125 granted Apr. 15, 2003. As such, the structure of the preferred embodiment is quite similar to that of Correll '125, with deviations occurring in the particular areas of structural innovation. Therefore, where applicable the essential material of the disclosure, discussion and terminology contained in Correll '125 is hereby included herein by this reference thereto.

Structure of the Preferred Embodiment

Figure 2:
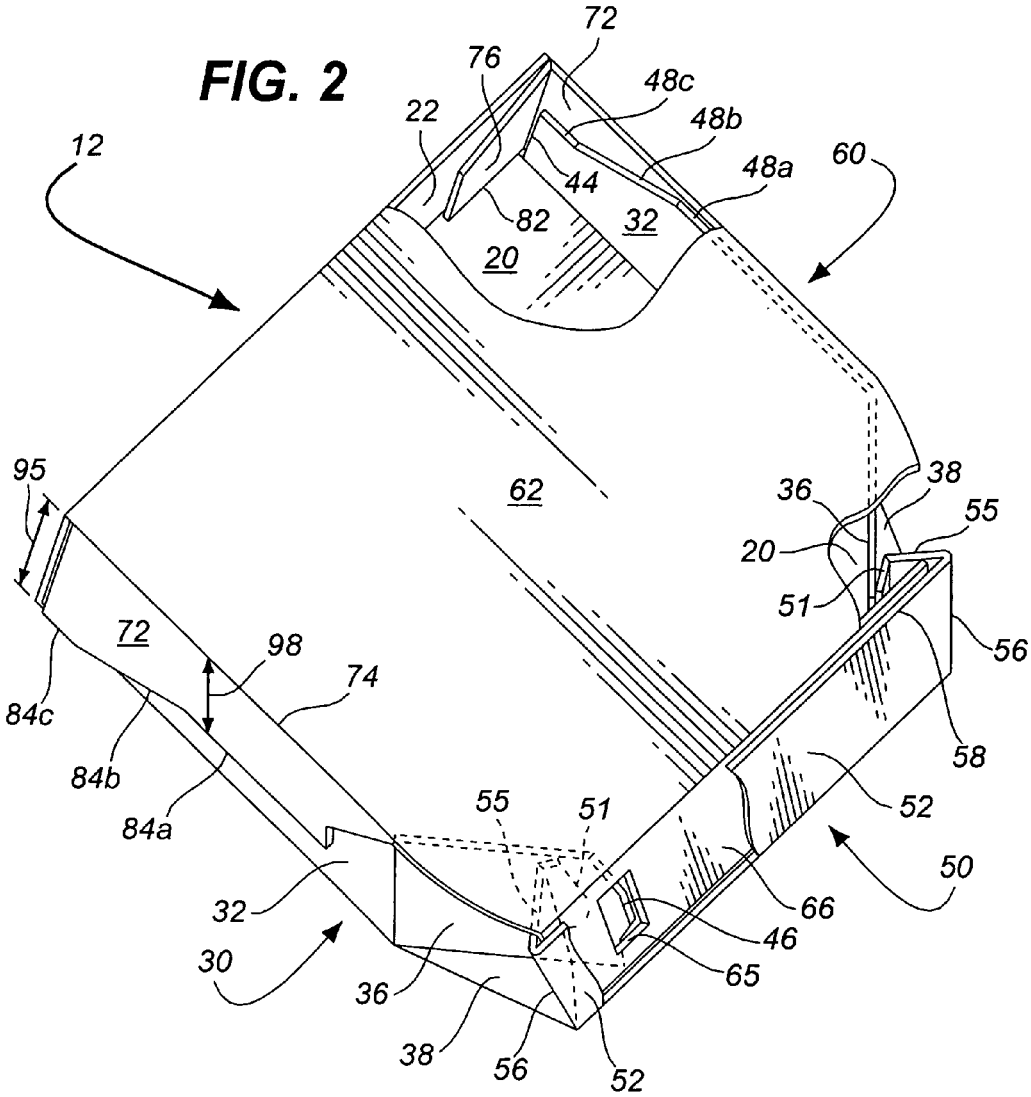
FIG. 2 shows a perspective view of a box erected from the blank of FIG. 1.

Referring now to the drawings, FIG. 1 shows a blank 10 and FIG. 2 shows a fully-erected box 12 created from blank 10. Referenced components are labeled in FIG. 1; selected components are labeled in other Figures.

Referring in particular to FIG. 1, blank 10 comprises a bottom panel 20, a rear wall 22 hingedly attached to bottom panel 20 at a rear wall fold line 24, and opposing left and right side wall assemblies 30.

Each side wall assembly 30 comprises a side wall panel 32 hingedly attached to bottom panel 20 at a side wall fold line 34 and disposed substantially perpendicular to rear wall 22. The assembly further comprises a front corner panel 36 hingedly attached to a front end of side wall panel 32 at front corner panel fold line 35, a connector panel 38 hingedly attached to a bottom edge 39 of front corner panel 36 at a fold line (also depicted by numeral 39) and to bottom panel 20 at a fold line 37.

Side wall panel 32 has a free rear end 44 that is obliquely disposed, or at an acute angle, to side wall fold line 34. In addition, side wall panel 32 has a top edge comprising a plurality of top edge portions including top edge portions 48*a*, 48*b*, and 48*c*. It is noted that top edge portion 48*a* is disposed substantially parallel to side wall fold line 34 and top edge portion 48*b* is disposed substantially non-parallel to fold line 34. Further, side wall panel 32 has two aligned breaker line slits 47. During the erection of blank 10 into box 12, these slits enable panel 32 to break, or crease, slightly on an imaginary line corresponding to these two aligned slits.

Front corner panel 36 has a front end edge 40 and an engagement tab 46 projecting from front end edge 40 and disposed coplanar to the remainder of corner panel 36. As such, panel 36 happens to be a tab-holding panel. As used herein, the term "tab-holding panel" refers to any panel (or flap) that has a tab, or tab-like projection, projecting from an edge of the panel.

The preferred embodiment further includes a front wall assembly 50. This assembly comprises a front wall 52 hingedly attached to bottom panel 20 at a front wall fold line 54. It further comprises left and right end flaps 55 hingedly attached to respective left and right ends of front wall 52 at an end flap fold line 56 and to connector panel 38 at a connector panel fold line 57. (See FIG. 3 for an enlarged depiction of this structure.) Front wall 52 has a top edge 58 that is free of attachment. Further, assembly 50 has left and right protector flaps 51 attached to end flaps 55 at protector flap fold lines 53. Protector flap 51 serves to protect engagement tab 46 from possibly being damaged during handling and transit of the box blanks.

Figure 3:
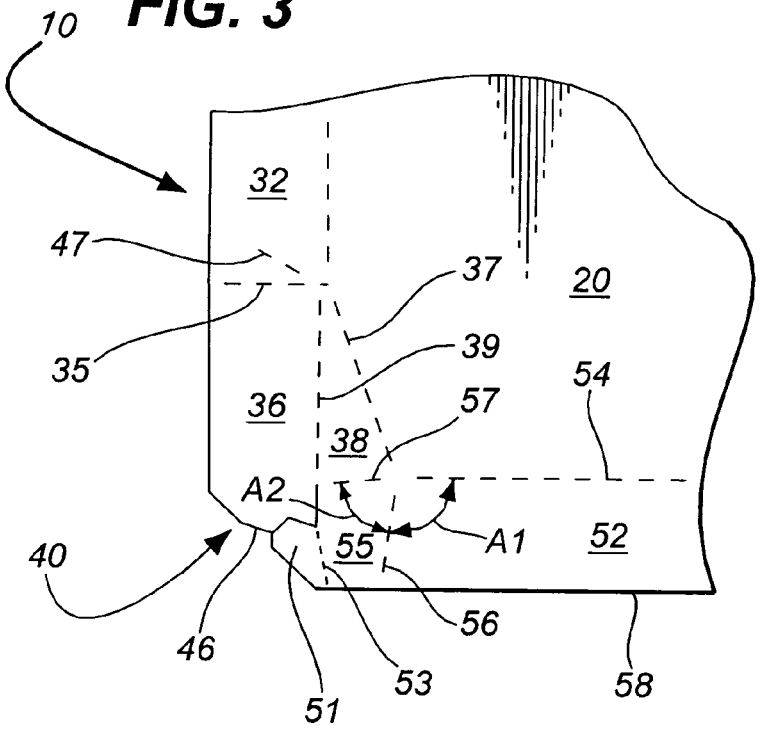
FIG. 3 shows an enlarged portion of a corner of the blank of FIG. 1.

Referring to FIG. 3, several important features are noted regarding fold lines 56, 57. First, end flap fold line 56 is disposed at an obtuse angle A1 to front wall fold line 54. Second, end flap fold line 56 is disposed at an acute angle (A2) to connector panel fold line 57. The optimal disposition of these fold lines, or the sizes of angles A1 and A2, depends on several factors, including the type of corrugated board used in making the blank and the degree of inward-slanting angle desired on front wall 52 of the box. Therefore, for any given box the determination of the optimal disposition of the fold lines, or the degree of angle between fold lines, is typically derived from testing, a function easily accomplished by any box designer skilled in the art. However, as a guide, it is noted that in the drawing of the preferred embodiment, obtuse angle A1 is approximately ninety eight degrees and acute angle A2 is approximately seventy six degrees. These angles are the recommended starting points for any testing which might be undertaken.

A cover assembly 60 comprises a full-length cover panel 62 hingedly attached to rear wall 22 at a cover panel fold line 64, a cover front flap 66 hingedly attached to a front edge of cover panel 62 at a cover front flap fold line 68, and left and right cover side flap assemblies 70. Cover front flap 66 has a bottom edge 69.

Cover assembly 60 further comprises a pair of first and second tab engaging edges 65. As illustrated in FIG. 2, when blank 10 is erected into box 12, tabs 46 engage with tab engaging edges 65 to hold cover assembly 60 in a closed disposition. In the preferred embodiment, each tab engaging edge 65 results from, or is a part of, a "hole" or opening 104 that is disposed in cover front flap 66. In FIG. 1, opening 104 is shown as a rectangular "hole" or a "knock-out" in the board. However, it is possible for the opening to take other shapes and configurations, particularly in the blank format.

Figure 4:
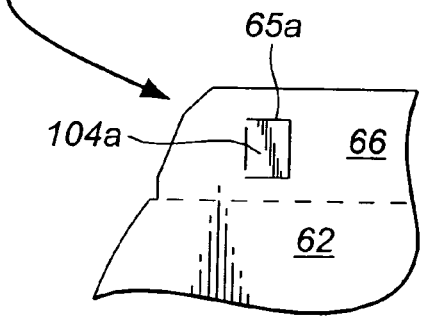
FIG. 4 shows a door or flap-type opening in the cover front flap of the blank of FIG. 1.
Figure 5:
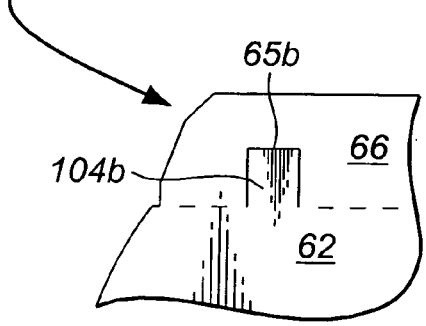
FIG. 5 shows a flip-tab type opening in the cover front flap of the blank of FIG. 1.

For example, the opening could be made by having a "door-like" opening, or flap, in the cover front panel. Referring to FIG. 4, this opening is shown as flap or hole configuration 104*a*. For this to work well, flap 104*a* should be crushed, thereby enabling engagement tab 46 to extend into the opening and engage with edge 65*a*. Still further, the opening could be made by having a "flip-tab" type structure in the cover front panel. This opening is shown as flip-tab configuration 104*b*, depicted in FIG. 5. When the blank is erected into a box and cover front flap 66 is tucked into the box, it causes flip-tab 104*b* to be disposed coplanar with cover panel 62 and, thereby, create an opening in the cover front flap. Engagement tab 46 (or a tab configured similarly thereto) then extends into this opening and engages with edge 65*b*.

Regardless of the type of opening used, the position, size, shape, and configuration of the opening that produces the tab engaging edge (65) should be such that it provides an optimal degree of engagement with tab 46. This optimal degree of engagement depends on several factors including type of corrugated board used in making the blank and the degree of inward-slanting angle used on front wall 52 of the box. Therefore, the optimal degree of engagement is determined through trial-and-error testing, a function easily performed by any competent packaging designer skilled in the art.

Each cover side flap assembly 70 comprises a cover side flap 72 hingedly attached to a side edge of cover panel 62 at a cover side flap fold line 74 that's disposed substantially perpendicular to rear wall 22. The cover side flap has a front end 75 that is free of attachment. It also has a lower edge comprising a plurality of lower edge portions 84*a*, 84*b*, and 84*c*. It is noted that lower edge portion 84*a* is disposed substantially parallel to cover flap fold line 74 and lower edge portion 84*b* is disposed substantially non-parallel to fold line 74.

Side flap assembly 70 further comprises a free-swinging corner flap 76 hingedly attached to a rear end of cover side flap 72 at a corner flap fold line 78. It is noted that corner flap fold line 78 is disposed at an obtuse angle to cover side flap fold line 74. The exact degree of the angle is whatever is needed to achieve the desired degree of inward-slanting angle for rear wall 22. Due to structural differences between boxes, such as differences in type of corrugated board, the final determination of the angle of fold line 78 may require testing, a function easily accomplished by any competent box designer skilled in the art.

It is also noted that corner flap 76 has a lower edge 82 that is non-aligned with lower edge portions 84*a*, 84*b*, 84*c* of cover side flap 72. The determination of the optimal angle between lower edge 82 and fold line 78 will also likely require trial-and-error testing. The optimal angle is whatever retains cover side flap 72 in a proper (vertical) position after blank 10 has been folded into box 12. (Specifically, in the drawing of the preferred embodiment, this angle is 90 degrees.)

At this point, several panel heights are noted. Specifically, rear wall 22 has a height 95. Cover front flap 66 has a height 96. Front wall 52 has a height 97. Cover side flap 72 has a minimum height 98. And side wall panel 32 has a maximum height 99. The minimum height of cover side flap 72 is the distance between fold line 74 and whatever portion of the lower edge of the side flap (i.e., 84*a/b/c*) that is closest to the fold line. Put another way, it is the length of the shortest distance between the lower edge and the fold line. The maximum height of side wall panel 32 is the distance between fold line 34 and whatever portion of the top edge of the side wall panel (i.e., 48*a/b/c*) that is farthest from the fold line. Alternatively put, it is the length of the longest distance between the top edge and the fold line.

It is further noted that minimum height 98 of cover side flap 72 is substantially less than maximum height 99 of side wall panel 32. This feature enables multiple adjacent blanks to be mated during manufacture for material savings. Minimum height 98 is also substantially less than rear wall height 95 and front wall height 97. Finally, it is noted that maximum height 99 of side wall panel 32 is slightly less than rear wall height 95.

Although not indicated with reference numerals, it is noted that in addition to maximum height 99 of side wall panel 32, the wall panel also has a minimum height. This minimum height of wall panel 32 is the distance between fold line 34 and whatever portion of the top edge of the side wall panel (i.e., 48*a/b/c*) that is closest to the fold line. Further it is noted that in addition to minimum height 98 of cover side flap 72, the side flap also has a maximum height. This maximum height of side flap 72 is the distance between fold line 74 and whatever portion of the lower edge of the side flap (i.e., 84*a/b/c*) that is farthest from the fold line. As regards both side wall 32 and cover side flap 72, the minimum height is substantially less than the maximum height.

For clarity of definition, it is noted that a chamfered region or a rounded or beveled corner section of a cover side flap does not constitute a portion of the lower edge of that side flap. Further, a chamfered region or a rounded or beveled corner section of a wall panel does not constitute a portion of the top edge of that wall panel. Still further, a chamfered region or a rounded or beveled corner section of a cover front flap does not constitute a portion of the bottom edge of that front flap. Finally, a chamfered region or a rounded or beveled corner section of a corner flap does not constitute a portion of the lower edge of that corner flap.

It is noted that several of the fold lines of the preferred embodiment are disposed at unique angles. Specifically, fold line 34 angles slightly inward from rear to front. Specifically, it's disposed at an approximate 89 degree angle to fold line 24. Fold line 74 angles slightly outward from rear to front. Specifically, it's disposed at an approximate 91 degree angle from fold line 24. Lastly, fold line 64 angles slightly upward from ends to middle. Specifically, dimension 95 (or the distance between fold line 24 and fold line 64) is one-eighth inch (three millimeters) higher at the center than at the ends. These unique fold line dispositions are not required for the functioning of the invention but can serve to slightly enhance its ease of use.

When the dimensional relationships cited in the preceding paragraphs are described in the appended claims, the terms "substantially less" and "substantially shorter" might be used. As used in the claims, the term "substantially less" means "at least ten percent shorter" and the term "substantially shorter" means "at least five percent shorter." The term "a substantial portion" means "at least twenty percent."

Referring to the fully-erected box (box 12 in FIG. 2), end flaps 55 extend diagonally inward from the ends of front wall 52. Cover front flap 66 is disposed between these end flaps. Front corner panels 36 extend diagonally forward from side wall panels 32 and front end 40 is adjacent to, or even abuts, cover front flap 66. Each protector flap 51 is disposed at an angle to end flap 55 and adjacent to front corner panel 36. This disposition tends to increase the structural rigidity or crush resistance of end flap 55 in the erected box format. Connector panels 38 overlie bottom panel 20. Cover side flaps 72 are disposed exterior to side wall panels 32 (hence they're sometimes called exterior cover side flaps).

Also seen in FIG. 2, it is noted that in the box format corner flaps 76 are perpendicular to cover side flaps 72 and disposed between rear end 44 of side wall panel 32 and rear wall 22. Lower edge 82 of corner flap 76 contacts bottom panel 20, thereby holding cover side flaps 72 in vertical or erected disposition. It is noted that this configuration is accomplished in spite of the fact that minimum height 98 of cover side flaps 72 is substantially less than height 95 of rear wall 22.

Operation of the Embodiment

Any method used for erecting the blank of Philips et al. '054 patent or Correll '125 patent into a box can be used for erecting the preferred embodiment into a box.

Specifically, the following method can be used, which is highly efficient.

First, position the blank so that it's horizontal and with the inside surface up and cover front flap 66 next to the abdomen.

Second, with your hands placed near the rear end of cover side flaps 72, simultaneously fold cover side flaps 72 inward and, with your index fingers, fold rear corner flaps 76 inward.

Third, while keeping your hands in that position (i.e., at the rear end of cover side flaps 72) and while holding the cover side flaps upright, with your fingers pull rear wall 22 upright.

Fourth, fold bottom panel 20 downward to about halfway closed.

Fifth, fold side wall panels 32 inward and position them interior to cover side flaps 72 and then fold bottom panel 20 down until the box is almost all the way closed.

Sixth, turn the partially-erected box to a vertical position with front wall assembly 50 up.

Seventh, open cover panel 62 about three inches and then, with your index fingers, push both front corner panels 36 inward. This will cause front wall assembly 50 to assume an upright position. This operation might result in a slight "breaking" of side wall 32 along breaker line slits 47*b*.

Eighth, fold cover front flap 66 down and tuck it between end flaps 55 and close the box completely. This step can sometimes be most easily executed with the rear end of the box held against a surface. This can be accomplished by either (a) holding the box vertically with the rear end resting on a table or (b) holding the box horizontally with the rear end held against your abdomen.

When sliding cover front flap 66 into closed disposition (or between end flaps 55), bottom edge 69 of flap 66 slides over and past tabs 46. Once cover panel 62 is in closed disposition, tabs 46 engage with tab engaging edges 65, or, specifically, with the lower edge of the "hole" that provides tab engaging edges 65 in the preferred embodiment, thereby holding cover assembly 60 in closed disposition. Further, when tabs 46 are of the proper size and configuration, bottom edge 69 of cover front flap 66 will slide easily past the tabs and the tabs will readily engage with tab engaging edges 65. The result will be that cover assembly 60 will be held in place in the closed disposition but can be easily opened with a reasonable amount of upward lifting force. If, during trial-and-error testing, it should turn out that it is difficult to close the cover onto the box or that the cover should not have the proper amount of cover closure resistance, simply adjust the size, shape, and/or position of tabs 46 (and/or perhaps the size and location of tab engaging edges 65) until the desired degree of resistance is achieved.

Mating of Multiple Blanks During Manufacture

Figure 6:
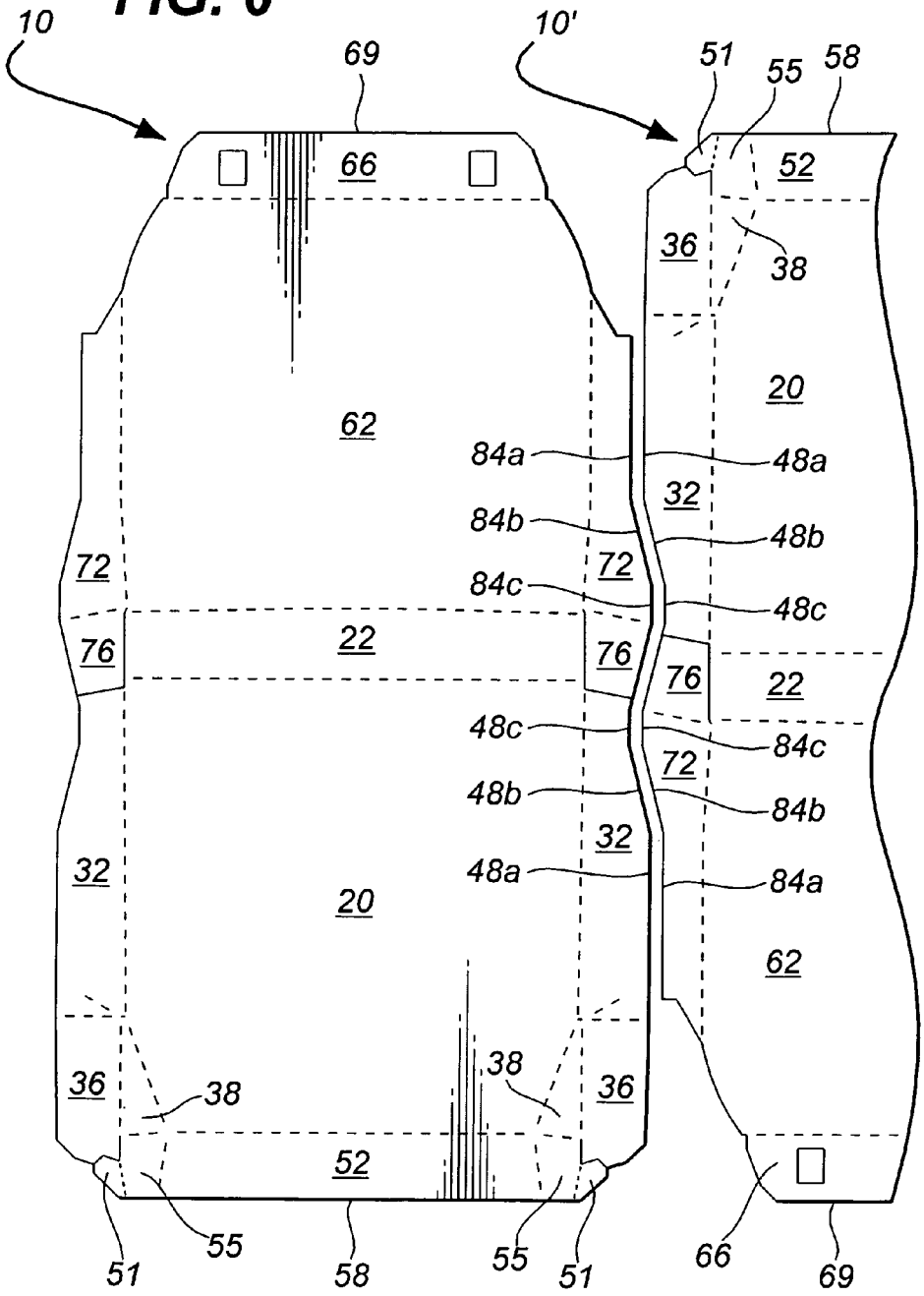
FIG. 6 shows two units of the blank of FIG. 1 disposed in inverted-mated configuration for manufacture.

FIG. 6, which shows identical blanks 10 and 10' oriented at 180 degrees to one another, depicts the configuration of multiple units of the preferred embodiment in a mated configuration for efficient manufacture. Even though only a partial section of blank 10' is depicted, this blank is of identical structure to that of blank 10. Further, in the drawing a small gap exists between the blanks. This gap is provided for clarity of illustration. In the actual manufacture of these blanks this gap would likely not exist and, instead, the adjacent edges of the blanks probably would be in contact with one another. Specifically, lower edge 84*a/b/c* of cover side flap 72 of each blank contacts, or is disposed adjacent to, top edge 48*a/b/c* of side wall panel 32 of the other blank. It is further noted that the furthermost extremities at each end of each blank (constituted by bottom edge 69 of cover front flap 66 and top edge 58 of front wall 52) are aligned with the furthermost extremities of the adjacent blank.

ALTERNATE EMBODIMENT

An alternate to the preferred embodiment will now be described. It is shown as blank 10X depicted in FIG. 7. It contains the same elements as blank 10 of the preferred embodiment (FIG. 1). However, in the alternate embodiment the height of the cover front flap is shorter than in the preferred embodiment. Specifically, in blank 10 of the preferred embodiment height 96 of cover front flap 66 is substantially equal to height 97 of front wall 52. However, in blank 10X of the alternate embodiment, height 96X of cover front flap 66X is substantially less that height 97 of front wall 52. In a five centimeter (two-inch) high pizza box in a format resembling that of the alternate embodiment, cover front flap height 96X will be shorter than front wall height 97 by approximately nine millimeters (three-eighths inch), thereby effecting a significant material savings.

Figure 7:
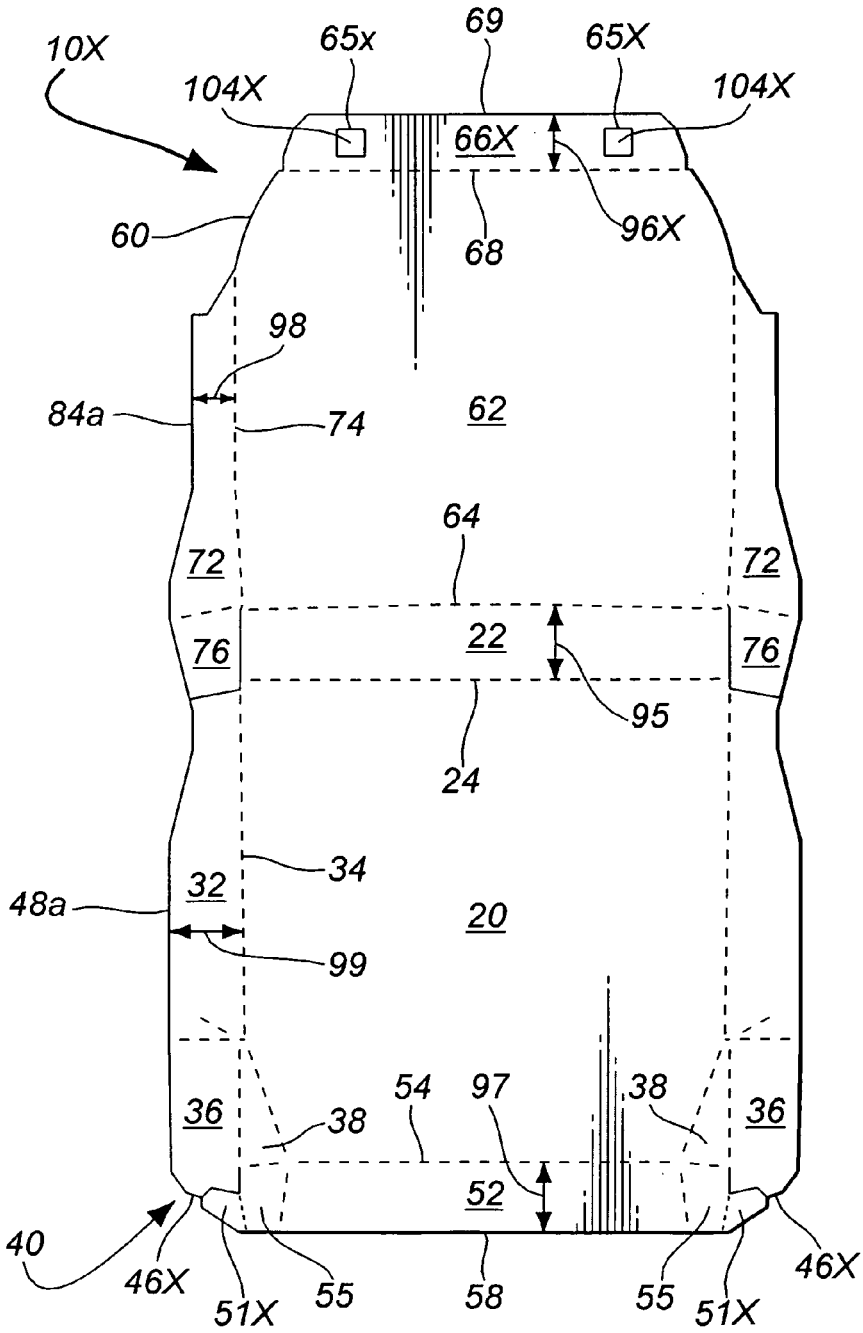
FIG. 7 shows a plan view of an alternate embodiment of the box blank.

It is noted that, because of the change in cover front flap height (96X), an alternate shape and/or location is required for the cover front flap opening, the engagement tab, and the protector flap, indicated by numerals 104X, 46X, and 51X, respectively, in FIG. 7.

DEFINITION OF KEY TERMS

Certain terms are used in the appended claims for describing the preferred embodiment. To insure clarity of meaning those terms are now specifically defined as used herein.

An "inward-slanting wall" is a wall disposed at an acute angle to a bottom panel. An example is front wall 52 and rear wall 22.

An "inward-slanting-wall box" is a box having at least one wall disposed at a substantially acute angle to the bottom panel of the box.

A "free-swinging" flap or panel is one that is attached to only one other flap or panel after the blank has been erected into a box. An example is corner flap 76.

A "tab engaging edge" is any portion of an edge of the board (e.g., corrugated board) that forms the cover assembly of the box and that engages with a tab disposed at a front end edge of a panel of a side wall assembly of the box. Example embodiments of a tab engaging edge include tab engaging edges 65, 65*a*, 65*b*, and 65X, created by openings 104, 104*a*, 104*b*, and 104X, respectively.

A "minimum height of a cover side flap" is the length of the shortest distance between the lower edge of the flap and the cover side flap fold line joining the flap to a cover panel, this "shortest distance" existing at a narrowest point between the fold line and the lower edge of the flap. For specificity of definition, it is noted that a chamfered region or a rounded or a beveled end or beveled corner section of a cover side flap does not constitute a portion of the lower edge of that side flap.

A "minimum height of a wall" is the length of the shortest distance between the top edge of the wall and the fold line joining the wall to a bottom panel, this "shortest distance" existing at a narrowest point between the fold line and the top edge of the wall.

A "maximum height of a wall" is the length of the longest distance between the top edge of the wall and the fold line joining the wall to a bottom panel, this "longest distance" existing at a widest point between the fold line and the top edge of the wall, as measured perpendicularly to the fold line. For specificity of definition, it is noted that a chamfered region or a rounded or a beveled end or beveled corner section of a wall panel does not constitute a portion of the top edge of the wall panel.

A "maximum height of a cover side flap" is the length of the longest distance between the lower edge of the flap and the cover side flap fold line joining the flap to a cover panel, this "longest distance" existing at a widest point between the fold line and the lower edge of the flap, as measured perpendicularly to the fold line.

A "cover front flap" is a flap attached to a front edge of a cover panel. For purposes herein, it is noted that the front edge of a cover panel is disposed opposite the rear edge of the cover panel, or opposite the edge of the cover panel that's attached to the rear end wall of the box. Accordingly, it is noted that a flap attached to a diagonal edge of a cover panel, such as an edge disposed between the front edge and a side edge, is not deemed to be a cover front flap but, instead, is deemed to be a cover diagonal flap.

A "corner flap" is a flap attached to an end of a cover side flap. For specificity of definition, it is noted that a chamfered region or a rounded or beveled corner section of a corner flap does not constitute a portion of the lower edge of the corner flap.

A "substantially acute angle" is considered herein to be an angle of 85 degrees or less.

A "substantially non-acute angle" is considered herein to be an angle greater than 85 degrees.

The term "substantially less" is considered herein to mean "at least ten percent shorter."

The term "substantially shorter" is considered herein to mean "at least five percent shorter."

The term "a substantial portion" means "at least twenty percent."

"Obliquely disposed" refers to an edge, panel, line, or plane that is disposed neither parallel nor perpendicular to another edge, panel, line, or plane.

A "side wall assembly" is a plurality of connected panels and/or flaps including at least one of the panels and/or flaps being a side wall attached to a side edge of the bottom panel of the box or blank.

A "front wall assembly" is a plurality of connected panels and/or flaps including at least one of the panels and/or flaps being a front wall attached to a front edge of the bottom panel of the box or blank.

A "cover side flap assembly" is a plurality of connected panels and/or flaps including at least one of the panels and/or flaps being a cover side flap attached to a side edge of the cover panel of the box or blank.

A "cover assembly" is a plurality of connected panels and/or flaps including at least one of the panels and/or flaps being a cover panel attached to a top edge of at least one of the walls of the box or blank.

A "full-length cover panel" is a cover panel that's hingedly attached to a wall of the box and possessing a length sufficient to enable the cover panel to extend from that wall substantially all the way to an opposing wall structure.

A "tab-holding panel" is any panel (or flap) that has a tab, or tab-like projection, projecting from an edge of the panel. An example is corner panel 36 that has tab 46.

A "prior-patent-disclosed combination of components" refers to a combination of blank or box components (i.e., walls, panels, flaps, fold lines, etc.) that have been previously described or disclosed in my U.S. Pat. No. 6,547,125 (which was published Mar. 13, 2003).

"Hingedly attached" refers to two panels (or box elements) joined together at a fold line, and does not imply any degree of movability of the panels in the erected box format.

"Linked" refers to two panels (or box elements) that are linked to one another either by a fold line (i.e., hingedly attached) or by some other means such as, for example, adhesive, glue, tape, staples, or a connecting strip or connector panel.

An "element" of a box or blank refers to any structure, or structural aspect, of the box or blank. Examples of box elements include, but are not limited to, panels, flaps, tabs, walls, fold lines, and so forth. The term "component" is synonymous with "element."

Within the drawing(s) of the blank(s), a fold line between component parts of the blank is depicted with a dashed line. The type of fold lines shown in the drawings are presently preferred but it will be appreciated that other methods known to those skilled in the art may be used. Within the context of this invention, a fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a crease, the longer slit may be slightly offset in alignment from the shorter slits or crease for the purpose of creating a slot along the fold line when the blank is set up into a box. Such an offset slit may be referred to herein as a "slot-forming slit." Nonetheless, the entire combination of long and short slits is considered to constitute a single fold line unless indicated otherwise. Also, as used herein the term "score" refers to a crease unless indicated otherwise.

In addition, to create a fold line where one panel is folded 180 degrees to lay parallel on another panel, the fold line may constitute two narrowly-spaced parallel scores or series of aligned slits. In this case, the two narrowly-spaced parallel scores or series of aligned slits constitute a single fold line unless indicated otherwise.

In conclusion, as referred to herein, a fold line is any line, either real or imaginary, between two points on the blank or box along which the board is intended to be folded when the blank is being erected into a box or when the box is being manipulated as described herein.

CONCLUSION, RAMIFICATIONS, AND SCOPE

The previously described preferred embodiment affords a number of potential advantages, including the following:

(1) A unique cover-locking structure comprising (a) a tab extending from a front end edge of a panel of a side wall assembly and (b) a tab engaging edge disposed in or on a cover assembly of the box and which engages with the tab, thereby acting to hold the cover in a closed disposition; and 2) A unique cover side flap assembly comprising a structure similar to that shown in Correll U.S. Pat. No. 6,547,125 except with the minimum height of the cover side flaps being substantially less than the maximum height of the rear wall and/or side wall panels of the box blank, thereby providing a possible way to mate two adjacent blanks during the manufacturing process.

The advantages of my invention are (1) a cover-locking structure that provides material savings along with ease of use and secure cover closure after repeated box opening-and-reclosings and (2) cost savings for the box manufacturer and/or pizzeria owner without any attendant operational inconvenience or deterioration of package integrity.

Within the foregoing discussion and in the appended claims, the labeling of certain components by a numerical adjective (e.g., "first," "second") is for reference purposes only and should not be construed as requiring any particular location or relative orientation of the components within an actual blank or box in order for that blank or box to be covered by the appended claims.

Further, the labeling of certain components by a directional adjective (e.g., "left," "right," "top," "bottom," "side," "base") is for purposes of describing the orientation or relationship between components and should not be construed as requiring an actual box or blank to be in any particular spatial or temporal orientation in order for it to be covered by the appended claims.

The terms "box" and "carton" are synonymous and used interchangeably herein.

Each of the terms "including," "having," "containing," "defining," "define," "characterized by," "composed of," and "group of" as used in the appended claims is to be interpreted as an open-ended transitional term construed to mean "including the following but not excluding others." The same is to be interpreted of the grammatical equivalents of those terms.

Any element in a claim that does not explicitly state "means for" performing a specified function, or "step for" performing a specified function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

The foregoing discussion has pertained mainly to packaging relatively flat food products such as pizza. However, it should be realized that my invention could be used for other purposes, as well.

The illustrated number, size, shape, placement, type, materials, form, function, and operation of components represent the presently preferred embodiment. However, it should be realized that many other combinations and configurations are possible within the scope of the invention, which will be apparent to those of ordinary skill in the art.

Hence, the proper scope of the present invention should be determined only by the broadest interpretation of the appended claims so as to encompass all such modification as well as relationships equivalent to those illustrated in the drawings and described in the foregoing description.

Further, the parenthetical inclusion of reference numerals within the detailed description and any of the appended claims should not be construed to mean that the particular claim only covers the preferred embodiment depicted in the drawings or that elements of any actual blank or box must have exactly the same shape or structure as that of the corresponding elements shown in the drawings in order for the claim to be deemed to cover an alternate version or embodiment of the invention. To the contrary, the inclusion of reference numerals within a claim is for the purpose of facilitating convenient reading of the claim and not for the purpose of limiting the scope of the claim. Hence, the parenthetical inclusion of reference numerals within a claim should be read with the implied phrase "for example" inserted within the parenthesis in front of the numeral.

Still further, it will be appreciated that the purpose of the annexed Abstract is to enable the U.S. Patent and Trademark Office and the public generally, and especially the technicians and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention and claims in any way.

Finally, while the above description contains precise terms and many specificities, these should not be construed as limitations on the scope of the invention but, rather, as exemplifications of what is presently deemed to be the best mode or most preferred embodiment(s) of the invention. Many other ramifications and variations are possible within the teachings and scope of the invention. In short, the invention should not be interpreted in view of the Abstract or limited to the disclosed embodiment and examples given but, on the contrary, should be determined by the appended claims and their legal equivalents. Thus, the scope of the claims is to be accorded the broadest interpretation so as to encompass all modifications and legally equivalent structures as is permitted under the law, including the doctrine of equivalents.

I claim:

1. A blank for a box having a unique cover-locking structure, this blank being of foldable material cut and scored to define:

a bottom panel (20), a rear wall (22) attached to the bottom panel, a front wall assembly (50) opposing the rear wall and comprising a front wall (52) attached to the bottom panel, a side wall assembly (30) comprising a side wall panel (32) attached to the bottom panel, a corner panel (36) attached to a front end of the side wall panel and having a front end edge (40) and a bottom edge (39), and a connector panel (38) attached to the bottom edge of the corner panel, and a cover assembly (60) comprising a cover panel (62) attached to the rear wall and a cover front flap (66) opposing the rear wall and attached to a front edge (68) of the cover panel;

wherein the corner panel has a tab (46) projecting from the front end edge and the cover assembly has a tab engaging edge (65), said tab engaging edge being of a disposition and configuration to enable this edge to engage with the tab after said blank has been erected into a box; and further wherein, the front wall assembly further comprises an end flap (55) attached to an end of the front wall at an end flap fold line (56), the front wall is attached to the bottom panel at a front wall fold line (54), an angle (A1) exists between the front wall fold line and the end flap fold line, wherein this angle is an obtuse angle.

2. A blank for a box having a unique cover-locking structure, this blank being of foldable material cut and scored to define:

a bottom panel (20), a rear wall (22) attached to the bottom panel, a front wall assembly (50) opposing the rear wall and comprising a front wall (52) attached to the bottom panel, a side wall assembly (30) comprising a side wall panel (32) attached to the bottom panel, a corner panel (36) attached to a front end of the side wall panel and having a front end edge (40) and a bottom edge (39), and a connector panel (38) attached to the bottom edge of the corner panel, and a cover assembly (60) comprising a cover panel (62) attached to the rear wall and a cover front flap (66) opposing the rear wall and attached to a front edge (68) of the cover panel;

wherein the corner panel has a tab (46) projecting from the front end edge and the cover assembly has a tab engaging edge (65), said tab engaging edge being of a disposition and configuration to enable this edge to engage with the tab after said blank has been erected into a box; and further wherein, the front wall assembly further comprises an end flap (55) attached to an end of the front wall and a protector flap (51) attached to the end flap.

3. A blank for a box having a unique cover-locking structure, this blank being of foldable material cut and scored to define:

a bottom panel (20), a rear wall (22) attached to the bottom panel, a front wall assembly (50) opposing the rear wall and comprising a front wall (52) attached to the bottom panel, a side wall assembly (30) comprising a side wall panel (32) attached to the bottom panel, a corner panel (36) attached to a front end of the side wall panel and having a front end edge (40) and a bottom edge (39), and a connector panel (38) attached to the bottom edge of the corner panel, and a cover assembly (60) comprising a cover panel (62) attached to the rear wall and a cover front flap (66) opposing the rear wall and attached to a front edge (68) of the cover panel;

wherein the corner panel has a tab (46) projecting from the front end edge and the cover assembly has a tab engaging edge (65), said tab engaging edge being of a disposition and configuration to enable this edge to engage with the tab after said blank has been erected into a box; and further wherein, the tab engaging edge is disposed in the cover front flap.

4. A box having a unique cover-locking structure, this box comprising:

a bottom panel (20), a rear wall (22), a front wall assembly (50) opposing the rear wall and comprising a front wall (52), a side wall assembly (30) comprising a side wall panel (32), a corner panel (36) attached to a front end of the side wall panel and having a front end edge and a bottom edge, and a connector panel (38) attached to the bottom edge of the corner panel, and a cover assembly (60) comprising a cover panel (62) attached to the rear wall and a cover front flap (66) opposing the rear wall and attached to a front edge of the cover panel;

wherein the corner panel has a tab (46) disposed at the front end edge and the cover assembly has a tab engaging edge (65) and the tab is engaged with the tab engaging edge, whereby the engagement of said tab with said tab engaging edge acts to hold said cover assembly in a closed disposition; and further wherein, the front wall assembly further comprises an end flap (55) attached to an end of the front wall and a protector flap (51) attached to the end flap.

5. A box having a unique cover-locking structure, this box comprising:

a bottom panel (20), a rear wall (22), a front wall assembly (50) opposing the rear wall and comprising a front wall (52), a side wall assembly (30) comprising a side wall panel (32), a corner panel (36) attached to a front end of the side wall panel and having a front end edge and a bottom edge, and a connector panel (38) attached to the bottom edge of the corner panel, and a cover assembly (60) comprising a cover panel (62) attached to the rear wall and a cover front flap (66) opposing the rear wall and attached to a front edge of the cover panel;

wherein the corner panel has a tab (46) disposed at the front end edge and the cover assembly has a tab engaging edge (65) and the tab is engaged with the tab engaging edge, whereby the engagement of said tab with said tab engaging edge acts to hold said cover assembly in a closed disposition; and further wherein, the front wall assembly further comprises an end flap (55) attached to an end of the front wall and a protector flap (51) attached to the end flap, wherein the protector flap is disposed at an angle to the end flap and adjacent to the connector panel.

6. A box having a unique cover-locking structure, this box comprising:

a bottom panel (20), a rear wall (22), a front wall assembly (50) opposing the rear wall and comprising a front wall (52), a side wall assembly (30) comprising a side wall panel (32), a corner panel (36) attached to a front end of the side wall panel and having a front end edge and a bottom edge, and a connector panel (38) attached to the bottom edge of the corner panel, and a cover assembly (60) comprising a cover panel (62) attached to the rear wall and a cover front flap (66) opposing the rear wall and attached to a front edge of the cover panel;

wherein the corner panel has a tab (46) disposed at the front end edge and the cover assembly has a tab engaging edge (65) and the tab is engaged with the tab engaging edge, whereby the engagement of said tab with said tab engaging edge acts to hold said cover assembly in a closed disposition; and further wherein, the tab engaging edge is disposed in the cover front flap.

* * * * *